United States Patent [19]

Busacca et al.

[11] Patent Number: 5,068,569

[45] Date of Patent: Nov. 26, 1991

[54] WAVE GUIDE DEVICE HAVING A PERIODIC STRUCTURE AND IMPROVED HEAT DISSIPATION

[75] Inventors: Guido Busacca; Antonio Muratore, both of Palermo, Italy

[73] Assignee: Selenia Industrie Elettroniche Associate S.p.A., Rome, Italy

[21] Appl. No.: 535,388

[22] Filed: Jun. 8, 1990

[30] Foreign Application Priority Data

Jun. 9, 1989 [IT] Italy ..... 48070 A/89

[51] Int. Cl.[5] ..... H01J 25/34

[52] U.S. Cl. ..... 315/3.5; 333/157; 315/3.6

[58] Field of Search ..... 333/156, 157, 138, 162; 315/3.5, 3.6

[56] References Cited

U.S. PATENT DOCUMENTS

| | | | |
|---|---|---|---|
| 3,015,750 | 1/1962 | Skowron et al. | 333/156 X |
| 3,324,338 | 6/1967 | Winslow | 315/3.5 |
| 3,517,347 | 6/1970 | Matsuoka et al. | 315/3.5 |
| 3,543,195 | 11/1970 | King | 333/157 |
| 3,832,593 | 8/1974 | Gross | 315/3.5 |
| 4,066,927 | 1/1978 | Gross | 315/3.5 |
| 4,307,322 | 12/1981 | Chaffee et al. | 315/3.5 |

*Primary Examiner*—Eugene R. LaRoche
*Assistant Examiner*—Seung Ham
*Attorney, Agent, or Firm*—Cohen, Potani & Lieberman

[57] ABSTRACT

An element with periodic structure for guiding electromagnetic waves propagating along a longitudinal axis of the structure at a speed below the velocity of light is disclosed. The structure includes a series of metal polar expansions aligned with the mentioned axis and forming a plurality of resonant metal cavities. The polar expansions have respective apertures aligned with each other so as to form a freeway for electron flow. First and second conductors are provided for cooperating with the polar expansions. The polar expansions each further respectively have first and second apertures for receiving first and second conductors that are preferably positioned diametrically opposed to each other with respect to the mentioned longitudinal axis. The first conductors are short circuited only to alternate ones of said polar expansions, and the second conductors are short circuited only to respective alternate ones of said polar expansions, such that each polar expansion is short circuited only to one of the first and second conductors.

6 Claims, 1 Drawing Sheet

WAVE GUIDE DEVICE HAVING A PERIODIC STRUCTURE AND IMPROVED HEAT DISSIPATION

BACKGROUND AND SUMMARY OF THE INVENTION

This invention relates to an element having a periodic structure capable of guiding electromagnetic waves. More particularly the invention relates to a element in which the periodic structure provides (i) propagation and stop bands (i.e. frequency bands in which a wave propagates without attenuation separated by bands in which the wave cannot propagate); and (ii) guidance of waves having a propagation velocity inferior to that of light.

A structure that offers the above-noted characteristics can allow the propagation of an electric field with a strong axial component which, during propagation at low speed, can interact with an electron flow.

The inventive periodical structure element, owing to the first property mentioned above, can be applied to microwave filters and, owing to the second property, it may find application in electric-charge accelerators and in microwave tubes.

For illustrative purposes, the invention will be described only with reference to the second property due to the interesting developments which it offers when applied to travelling wave tubes and to electric-charge accelerators.

Such type of tube is in principle formed by the following items:

an electron gun that emits an electron beam at a prefixed speed;

a waveguide to input an electromagnetic wave into the tube;

an element with the task of propagating the electromagnetic field generated by the above-mentioned wave;

an output waveguide to pick up and make available the output signal; and a collecting electrode that gathers the electrons of the beam above and puts them back into circulation.

A tube of the type described forms an amplifier based upon the interaction between the electron beam and the electromagnetic field originated by the signal to be amplified, which propagates at a speed slightly lower than that of the electrons. The alternating electric field of the wave causes a modulation of the electrons of the beam and this results in a modulation of the density of the beam itself. If the velocity of the electron beam is greater than the speed at which the electromagnetic field propagates along the structure axis, the electrons find a systematic perturbation induced onto their motion; consequently, the electrons slow down, releasing energy to the electric field, which is in turn passed onto the wave that propagates along the structure. As the waveguide for output signal collection is set at the end of the structure, it follows that the electromagnetic wave picked up there has a higher energy level than the wave input to the tube.

The amplifying effect of the tube is a function of the coupling between the electromagnetic field and the electron flow. To keep such coupling within values that provide a reasonable amplification level, it is necessary to shape the guidance element so that a part of such electron flow (or beam current) is intercepted, causing generation of heat.

In tubes with coupled cavities of known configuration, there are upper limits to the thermal dissipation capability that are due to the large azimuthal dimensions of the coupling posts which cause an increase of the thermal resistance between the areas subject to maximum heat and those connected directly to the cooling circuit.

An object of this invention is to provide an element for guiding electromagnetic waves that minimizes to a considerable extent the drawbacks mentioned above. The invention presented offers the possibility of introducing distributed losses along the entire structure, making use of wires with a resistive surface which, when the element is used in a travelling wave tube, provides for the elimination of undesired oscillations.

The electromagnetic-wave guiding element, made in accordance with the invention, will therefore offer a structure in which the connecting posts between cavities are replaced by circular holes having a reduced cross section, and the coupling among cavities is obtained by means of conductive wires which cross the cavity.

Such structure, as in the case of already known coupled cavity structures, is periodic and it therefore presents all the characteristics mentioned above.

BRIEF DESCRIPTION OF THE DRAWING FIGURES

A preferred form of the invention is now described with reference to the accompanying figures, in which.

DETAILED DESCRIPTION OF THE PREFERRED EMBODIMENT

Figure 1:
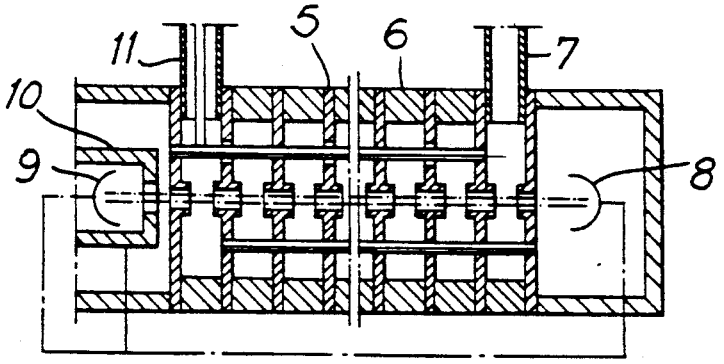
FIG. 1 shows an example of a generic travelling wave tube into which the subject element of the invention is to be inserted.
Figure 2:
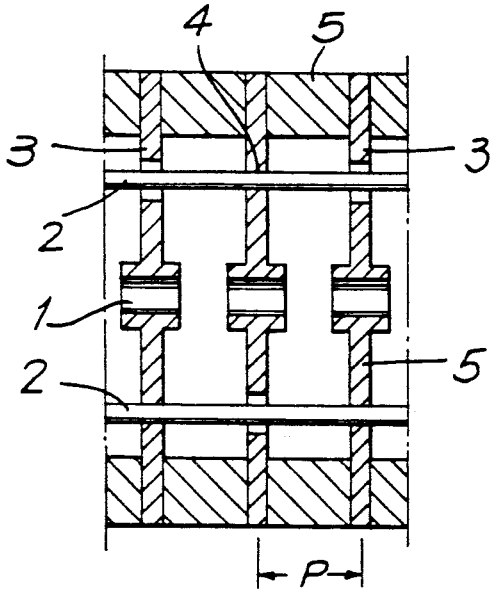
FIG. 2 depicts a section of an elementary cell of the subject element of the invention.

FIGS. 1 and 2 illustrate a freeway 1, coupling conductors 2, a coupling hole 3, a short-circuit hole 4, a polar expansion 5, period P of the element, and a spacer 6.

The section of the inventive guide element shown in FIG. 2 has a pitch equal to P. Such structure is obtained by a set of polar expansions 5 and spacers 6. Two holes are made in polar expansions 5, radially opposite each other, one with a diameter suitable to assure an electrical contact with a coupling conductive wire 2 and the other with a diameter suitable for a correct frequency response of the structure.

Figure 3:
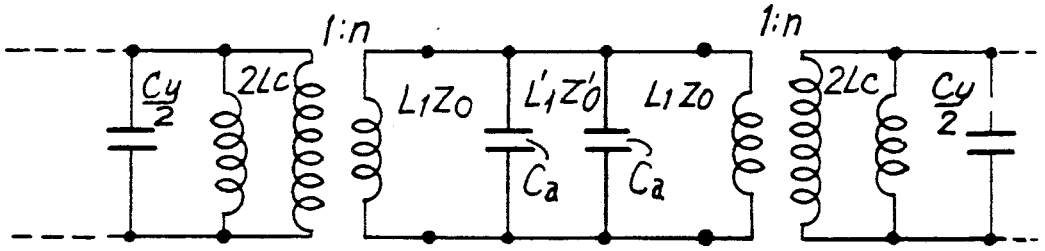
FIG. 3 is a simplified circuit model for explaining aspects of the invention.

For a better understanding, such conductors are shown as diametrically opposite each other with respect to the axis of the periodical structure; however this feature is not critical. The element which is the subject of the present invention can be further understood by observing the behavior of the electric circuit shown in FIG. 3. Such electrical circuit represents the equivalent circuit of an elementary cell of the inventive element. FIG. 3 is, however, a simplified circuit model to aid in explaining the structure of the inventive element.

The inventive element is used in a travelling wave tube as shown, for example, in FIG. 1, which has the task of propagating an electromagnetic field. Such tube has a cathode 9 and an anode 10 which provides for the acceleration of electron flow output by the cathode. Such flow moves within the structure and ends on the collector element 8. The signal to be amplified is applied to an end of the structure by means of an input waveguide 11, and generates an axial electrical field by propagating along such structure.

If the phase velocity of the wave travelling along the structure has a predetermined relationship with the electron flow phase velocity crossing anode 10, an interaction between the electron flow and the radio-frequency field takes place. The electron flow therefore releases energy to the radio-frequency field, and it therefore follows that the signal picked up on the output waveguide 7 is amplified with respect to the signal applied to input waveguide 11. Part of the electrons of such flow is intercepted by the structure although such type of tube is equipped with focusing elements (not shown).

The structure built in accordance with the foregoing description ensures an easy dissipation of the heat generated by the interception mentioned above, which is especially useful in connection with higher power electron tubes. When compared to previous solutions, the element herein presented offers the advantage of efficient heat dissipation and a clearly simplified manufacturing process, which results in cost reduction.

It should be understood that the preferred embodiments and examples described are for illustrative purposes only and are not to be construed as limiting the scope of the present invention which is properly delineated only in the appended claims.

What is claimed is:

1. An apparatus having a projected ion beam and a periodic structure for guiding electromagnetic waves propagating along a longitudinal axis of the structure at a speed below the velocity of light and for providing dissipation of heat provided in the structure, said structure comprising:

a series of metal polar expansions aligned with said axis and forming a plurality of resonant metal cavities;

said polar expansions having respective freeway apertures aligned with each other so as to form a freeway for electron flow of said ion beam;

first and second conductors traveling at least the length of at least two of said expansions in said series and having an electrically conductive wire having a core and a surface portion having a greater resistance than the core, for cooperating with the polar expansions;

said polar expansions each further respectively having first and second conductive apertures for receiving said first and second conductors; and said first conductors being short circuited only to alternate ones of said polar expansions, and said second conductors being short circuited only to respective alternate ones of said polar expansions such that each polar expansion is short circuited only to one of said first and second conductors while providing an aperture of sufficient diameter for said nonshort circuited conductor to pass therethrough and for heat to be dissipated from said non-short circuited conductor.

2. The apparatus according to claim 1, wherein said first and second apertures in each of said polar expansions is positioned diametrically opposed to each other with respect to said longitudinal axis.

3. The apparatus according to claim 1, wherein said structure is adapted to be inserted into a travelling wave tube.

4. The apparatus according to claim 1, wherein said structure is adapted to be inserted into a particle accelerator.

5. The apparatus according to claim 1, wherein said structure is adapted to be used in a microwave signal filter.

6. The apparatus according to claim 1 wherein said heat is dissipated from said resistive surface portion of said non-short circuited conductor to said polar expansion through which it passes.

* * * * *